US006639133B1

(12) United States Patent
Wroblewski

(10) Patent No.: US 6,639,133 B1
(45) Date of Patent: Oct. 28, 2003

(54) UNIVERSAL PIANO ACTION STRIKING VERTICAL AND HORIZONTAL STRINGS FROM BELOW AND ABOVE

(76) Inventor: Richard Wroblewski, 701 Silver La., Trumbull, CT (US) 06611

( * ) Notice: Subject to any disclaimer, the term of this patent is extended or adjusted under 35 U.S.C. 154(b) by 0 days.

(21) Appl. No.: 09/669,001

(22) Filed: Sep. 25, 2000

Related U.S. Application Data

(60) Provisional application No. 60/156,332, filed on Sep. 28, 1999.

(51) Int. Cl.[7] ..... G10C 3/00

(52) U.S. Cl. ..... 84/216; 84/219; 84/221; 84/223; 84/224; 84/236; 84/237; 84/238; 84/239; 84/240; 84/241; 84/242; 84/243

(58) Field of Search ..... 84/216, 219–225, 84/228, 236–243

(56) References Cited

U.S. PATENT DOCUMENTS 1,094,421 A * 4/1914 Bjorkland ..... 84/241
2,928,307 A * 3/1960 Anderson ..... 84/237
4,995,291 A * 2/1991 Takahashi ..... 84/237
5,511,454 A * 4/1996 Jones et al. ..... 84/236
5,756,911 A * 5/1998 Paterson ..... 84/220

FOREIGN PATENT DOCUMENTS

JP 10161641 * 6/1998

OTHER PUBLICATIONS

Piano Servicing, Tuning, and Rebuilding, Arthur A. Reblitz Library of Congress Cataloging in Publication Data Vestal Press, Ltd, Vestal, New York, 1993.*

* cited by examiner

*Primary Examiner*—Shih-Yung Hsieh

(57) ABSTRACT

A universal piano action having a minimum number of identical parts interchangeable in upright and grand pianos, under and above the tensioned strings and effecting rapid repetition in upright and grand pianos, this universal piano action responds to every strenght of touch evoking sounds from a whisper to thunder.

Figure 1:
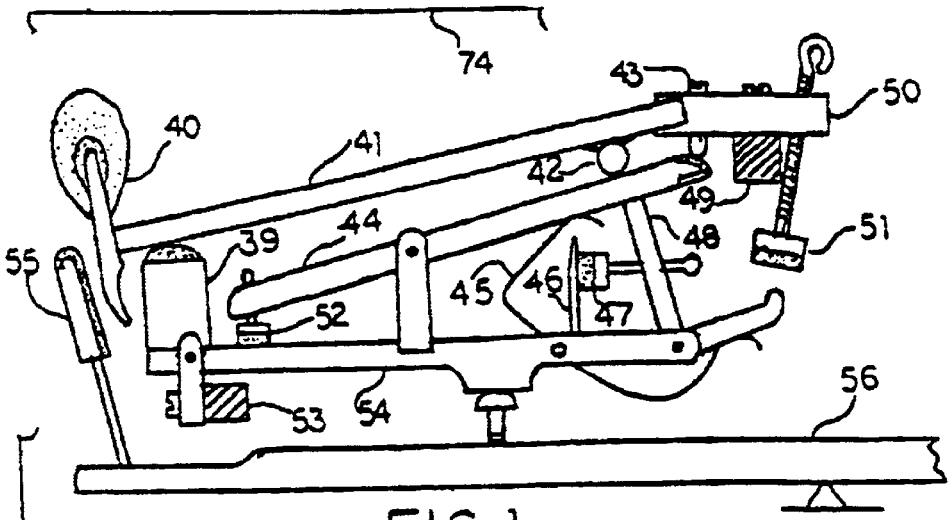
FIG.1 PRIOR ART

In this universal piano action the hammers can be positioned to any at rest position, to any proximity in respect to the tensioned strings for a sensitive control of sound, permitting practice playing with a normal strenght of piano key touch without disturbing.

64 Claims, 11 Drawing Sheets

UNIVERSAL PIANO ACTION STRIKING VERTICAL AND HORIZONTAL STRINGS FROM BELOW AND ABOVE

This application claims the benefit of Provisional Application Ser. No. 60/156,332, filed Sep. 28, 1999.

FIELD OF THE INVENTION

This invention relates to a universal piano action of simple design comprising of a minimum number of parts for striking vertical and horizontal strings from below and above the horizontal strings.

BACKGROUND OF THE INVENTION

Upright and grand pianos still have numerous parts, especially the grand piano with the complicated and costly rube goldberg arrangement to effect fast repetition of notes, and the upright piano still is without the repetition feature. The complicated arrangement in the grand piano causes friction leading to wear and tear and noise requiring frequent regulation and lubrication.

The upright and grand pianos have a soft pedal to soften the sound, the soft pedal in the upright piano is somewhat productive but in the grand piano the soft pedal degrades the grand piano tone by striking fewer strings to soften the sound.

The use of the soft pedal in the grand piano reveals the recognition of lack of sensitivity in the conventional grand piano arrangement. Except for the extremes of lightly touching a piano key and banging the piano key with great force together with the soft pedal to soften the sound expressions of intermediate degrees of loudness or softness have been substantially impossible.

The conventional grand piano action is complex and expensive to make requiring precision with special machinery, and yet it is plagued by friction, wear and tear and noise requiring frequent regulation and lubrication. The conventional grand piano action is still being emplaced under the tensioned strings as a more appropriate emplacement over the tensioned strings was unsuccessful.

The conventional upright and grand actions have a antiquated rube goldberg escapement arrangement for disengaging the jack before the piano hammer strikes the tensioned-string. This escapement arrangement in the complicated grand action causes excessive friction leading to wear and tear and noise requiring frequent adjustment and lubrication.

The piano action of the present invention is of a simple construction and arrangement comprising of a minimum number of parts the parts are identical to interchange in upright and grand pianos for striking vertical and horizontal strings from below or from above the horizontal strings, the-piano action of the present invention does not require an escapement let off mechanism to disengage the jack, the arrangement is direct without interconnecting parts, there is no double striking in this simple arrangement.

Basically this simple arrangement comprises of a pivotal member carrying a piano hammer, and a yielding jack, the yielding jack being flexible or substantially rigid supported by a spring and positioned on a rear portion of a piano key. The pivotal member carrying the piano hammer being in continual contact with the yielding jack. This simple piano action effects fast repetition of notes exactly as in the complicated grand piano action.

This simple piano action makes it possible for upright pianos to have this repetition feature. This simple arrangement of the present invention does not need the conventional soft pedal found in upright and grand pianos to degrade grand piano tone by striking fewer strings.

This simple piano action of the present invention, permits a complete dynamic range as in percussion instruments struck with a striker or mallet, this complete dynamic range is impossible to attain in the conventional grand piano action. This simple piano action permits a maximum striking force, with sensitive elastic control, it is like striking the tensioned strings directly with a striker or mallet evoking sounds from a whisper to thunder.

This simple arrangement effects a superior repetition action with movement of the piano key from one eight of an inch up from the bottom. U.S. Pat. No. 4,995,291 illustrates a jack having a flexible bottom.

OBJECTS OF THE INVENTION

A primary object is to provide the ultimate.

Another object is to provide a piano action for upright and grand pianos of a minimum number of identical parts for striking vertical strings and horizontal strings from below and above.

Another object is to provide a desirable grand piano downward striking action that can be clearly seen by the pianist.

Another object is to provide an upright piano having fast repetition of notes as in a grand piano.

Another object is to provide a grand piano without a soft pedal degrading tonal character by striking fewer strings.

Another object is to provide a piano action responding to every strenght of piano key touch.

Another object is to provide a grand piano action to be substantially regulation free.

Another object is to provide a piano action with a minimum number of simple parts that is easy to make at very low cost.

Another object is to provide a grand piano action not impeded by excessive friction.

Another object is to provide a grand piano action that will not become noisy.

Another object is to provide a piano that is easy to play pianissimo presto without missing notes.

Another object is to provide an upright piano having strings of grand piano lenght and fast repetition of notes for a small room.

Another object is to provide a piano with a superior action.

Another object is to eliminate the escapement mechanism in upright and grand pianos.

DETAILED DESCRIPTION OF THE DRAWINGS

FIG. 1 in a side view illustrates a conventional grand piano action.

Figure 2:
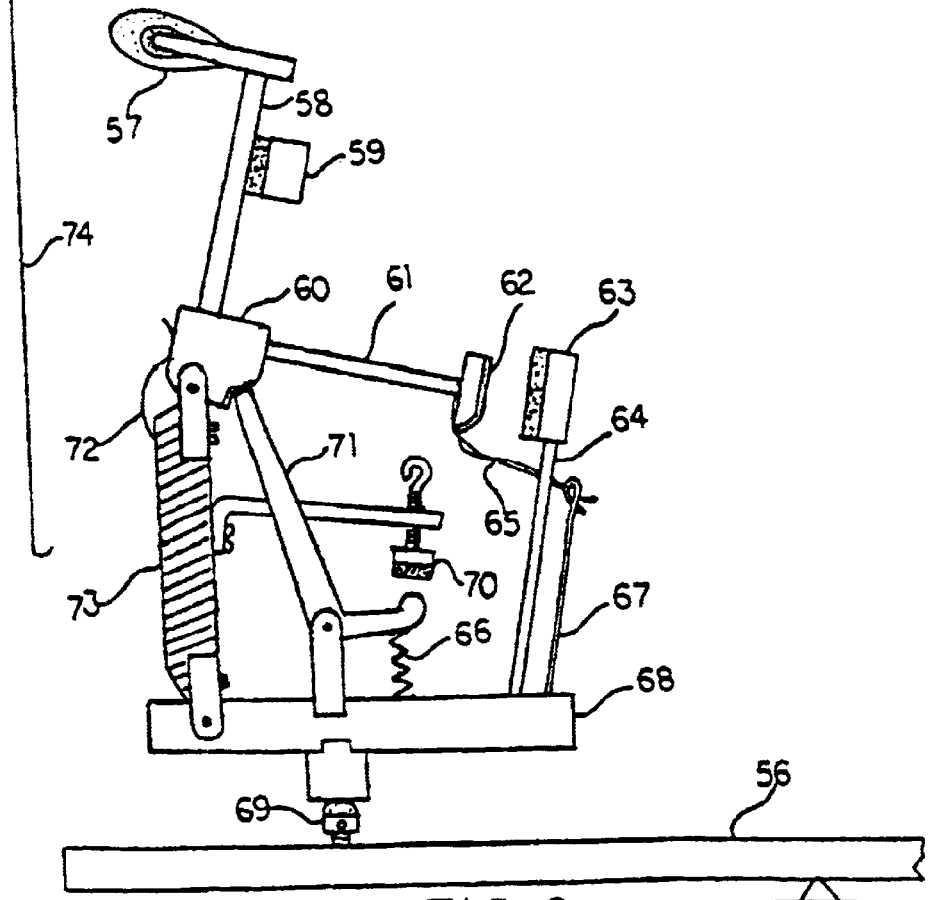
FIG.2 PRIOR ART

FIG. 2 in a side view illustrates a conventional upright piano action.

Figure 3:
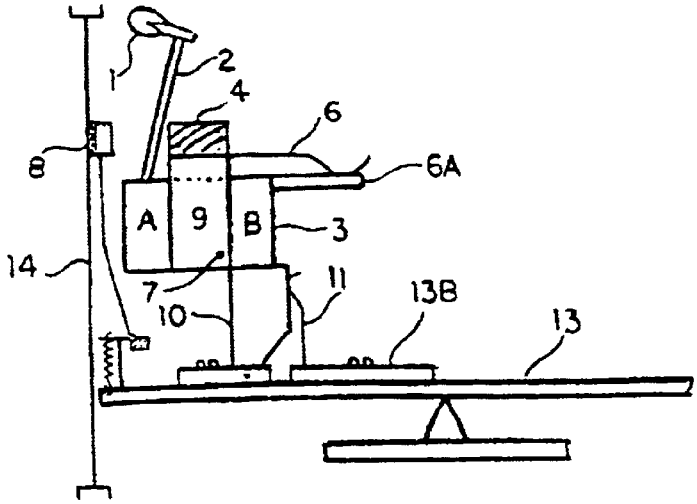

FIG. 3 in a side view illustrates an arrangement of identical parts to strike a vertical string.

Figure 4:
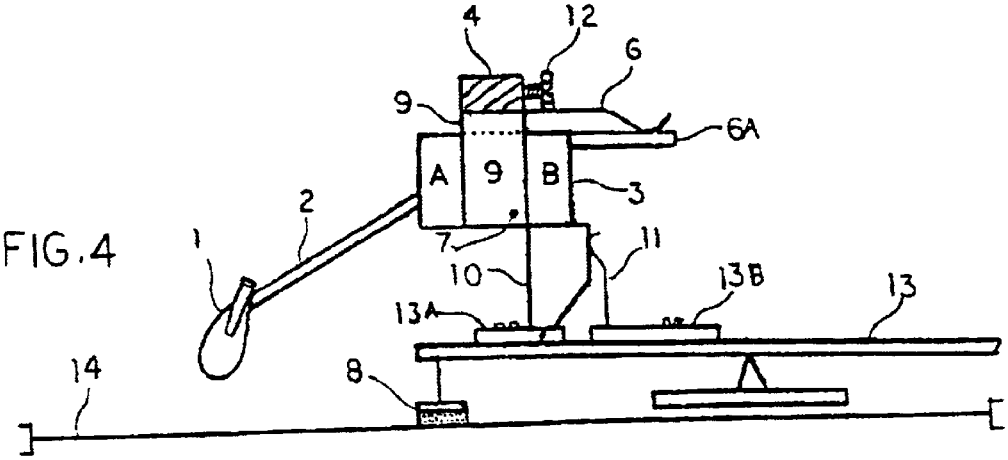

FIG. 4 in a side view illustrates an arrangement of identical parts to strike a horizontal string from above.

Figure 5:
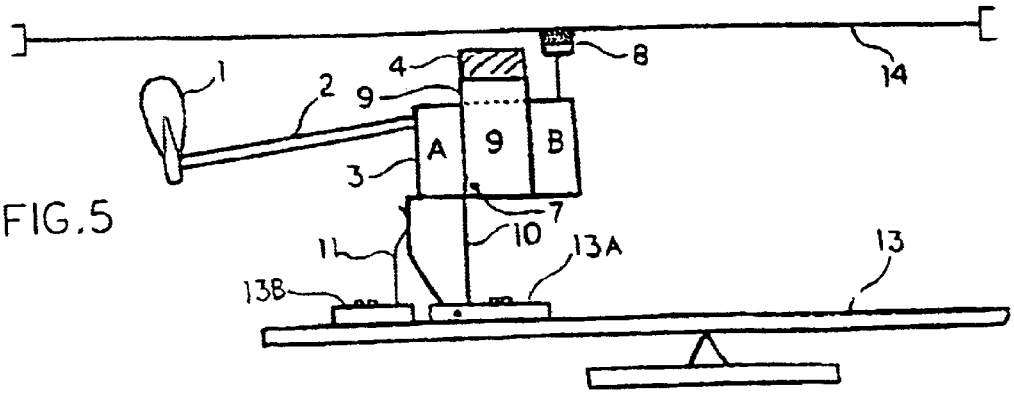

FIG. 5 in a side view illustrates an arrangement of identical parts to strike a horizontal string from below.

Figure 6:
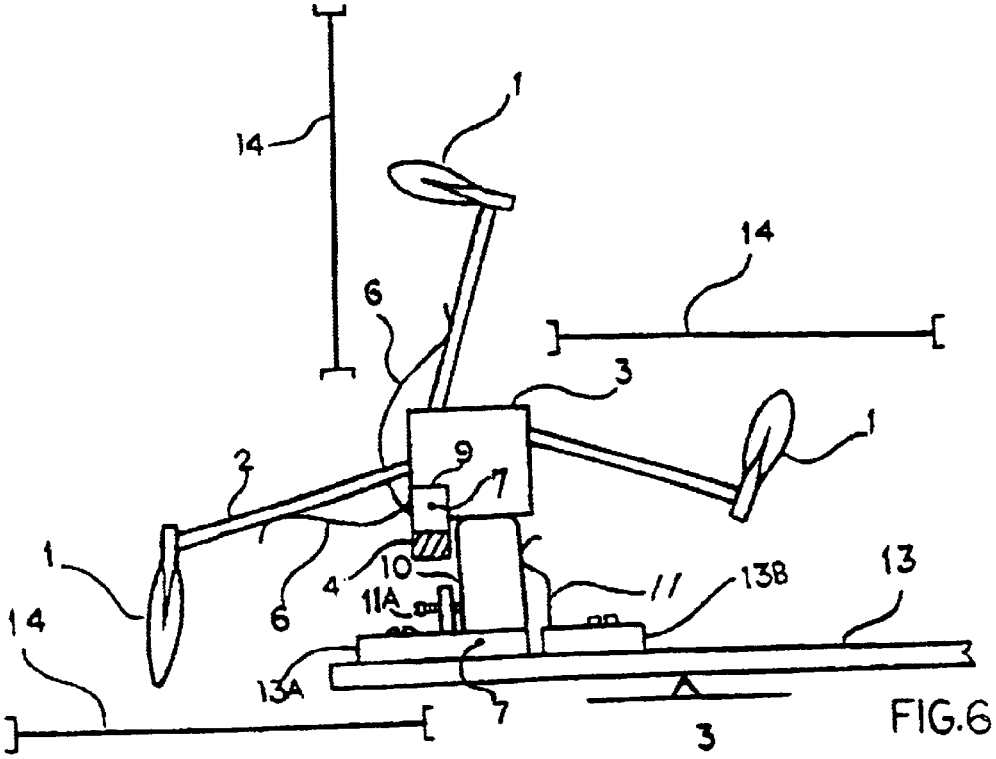

FIG. 6 in a side view illustrates a piano hammer 1 positioned on a pivotal member 3 in different attitudes to strike vertical strings and horizontal strings from above and from below the horizontal strings.

Figure 6A:
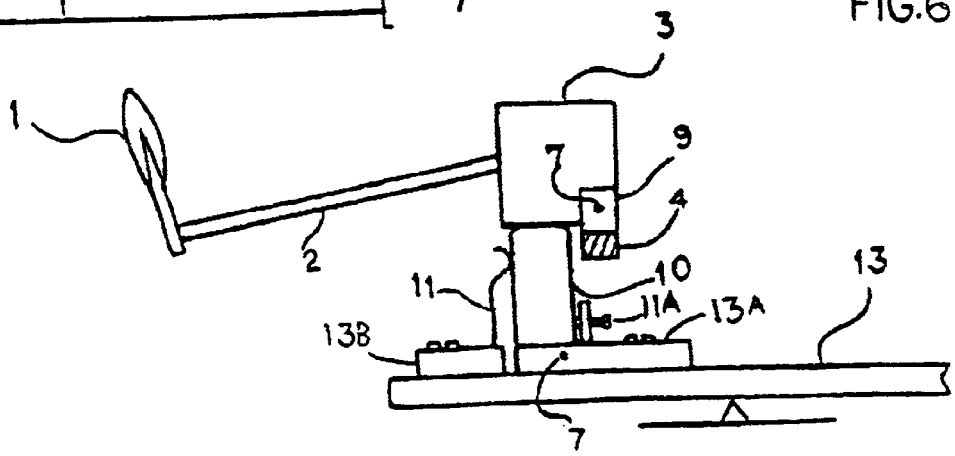

FIG. 6A in a side view illustrates the pivotal member 3 carrying the piano hammer 1 being reversed from FIG. 4 to strike a horizontal string 14 from below in a conventional grand piano layout.

Figure 7:
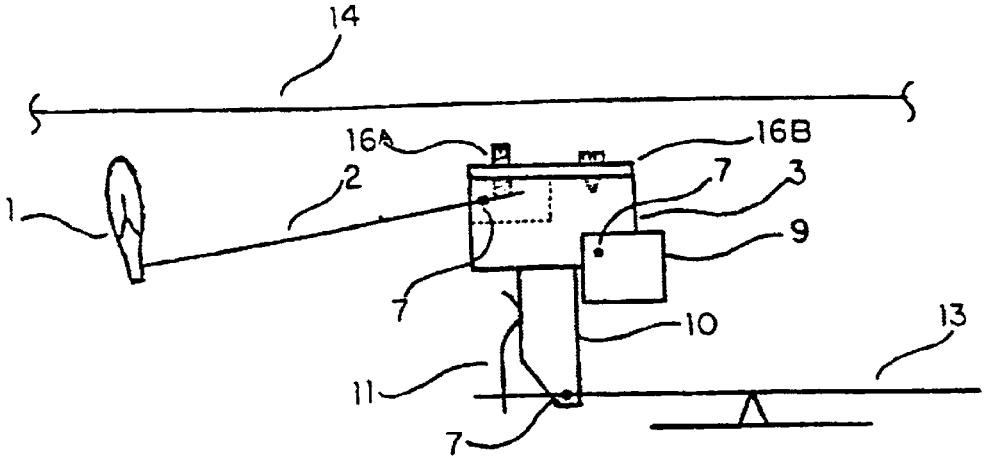

FIG. 7 in a side view illustrates a pivotal jack 10 supported by a spring 11 on a rear portion of a piano key 13 the pivotal member 3 carrying the piano hammer 1 resting on the pivotal jack 10 a hammer shank 2 carrying the piano hammer 1 being connected pivotally to the pivotal member 3, the angle of the hammer shank 2 being regulated by a screw 6A abutting a proximal end of the hammer shank 2.

Figure 8:
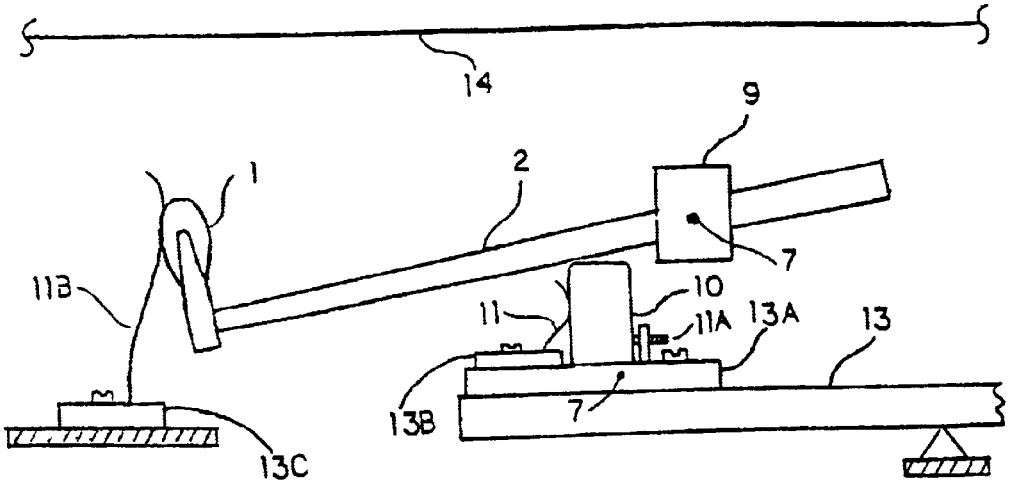

FIG. 8 in a side view illustrates the pivotal jack 10 supported by the spring 11 positioned on the piano key 13 under the pivotal hammer shank 2 in a conventional grand piano layout.

Figure 9:
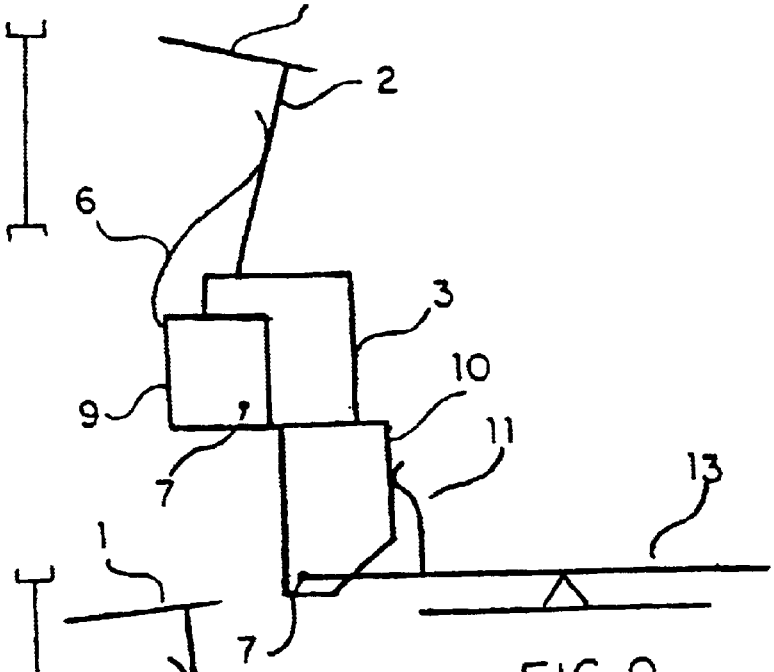
Figure 10:
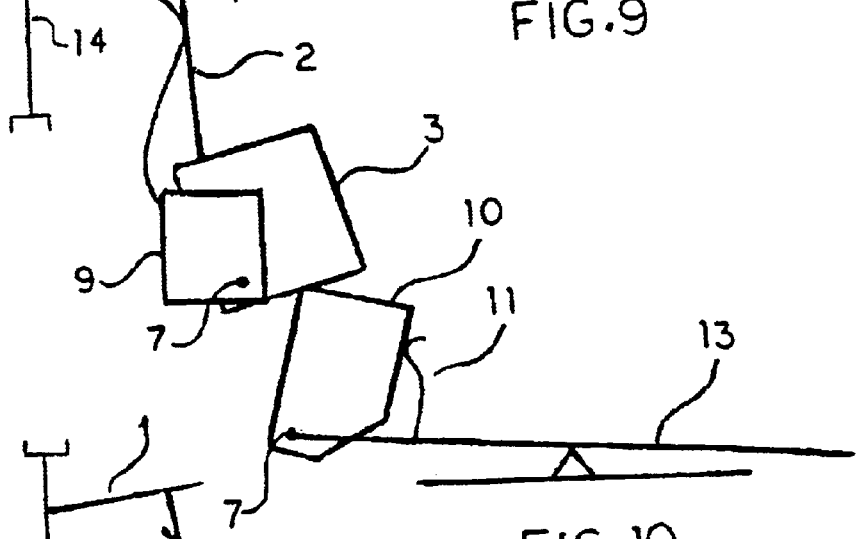
Figure 11:
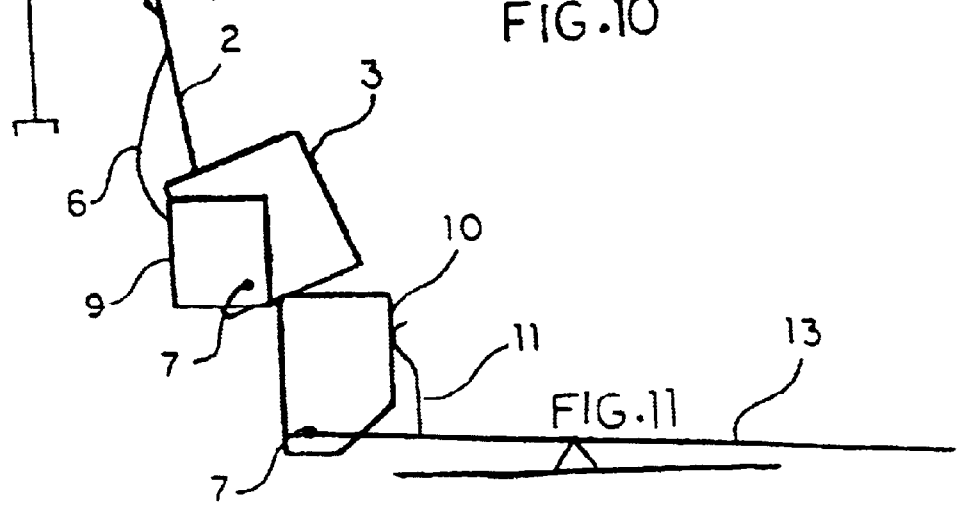

FIGS. 9, 10 and 11, in a side view illustrate sequential movement of the arrangement.

Figure 12:
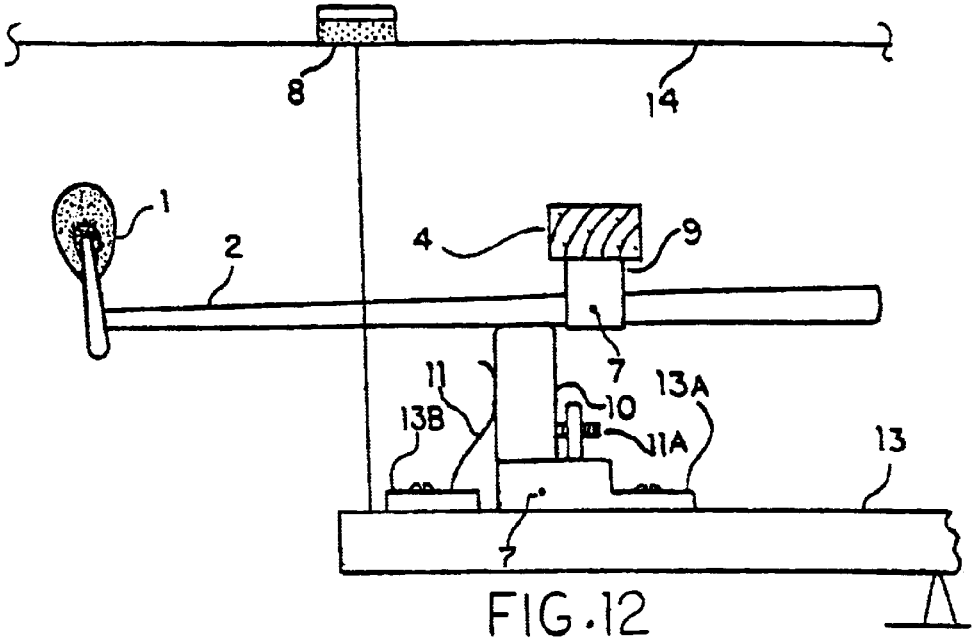

FIG. 12 in a side view illustrates a pivotal jack 10 under a pivotal hammer shank 2 carrying a piano hammer 1 to propel the piano hammer 1 to strike a horizontal string 14 from below.

Figure 13:
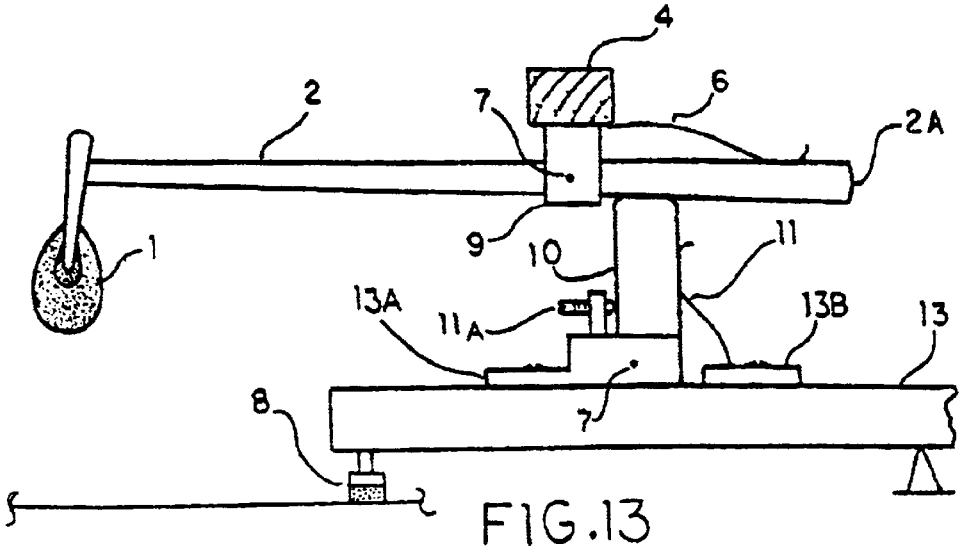

FIG. 13 in a side view illustrates the pivotal jack 10 under an extended proximal end of the pivotal hammer shank 2 carrying the piano hammer 1 to propel the piano hammer 1 to strike the horizontal string from above the horizontal string 14.

Figure 14:
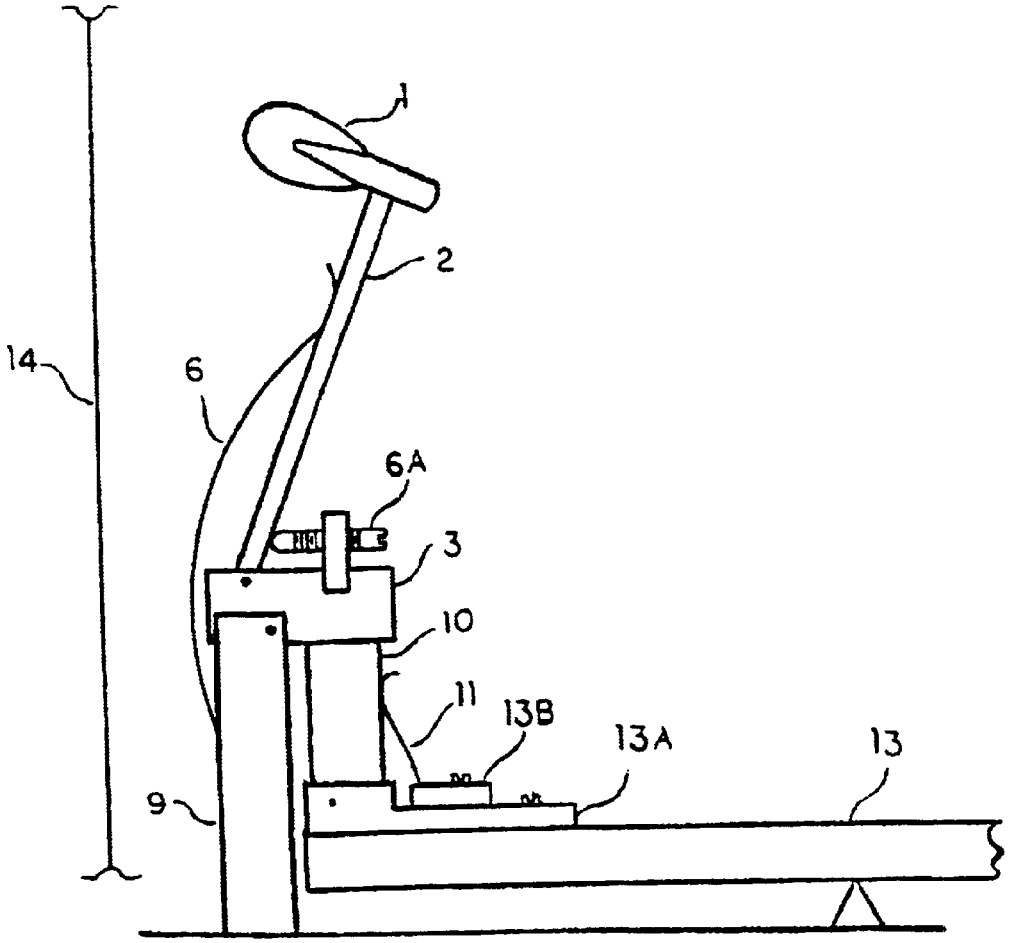

FIG. 14 in a side view illustrates a spring 6 pressing the pivotal hammer shank 2 against a regulating screw 6A regulating proximity of the piano hammer 1 carried by the hammer shank 2 in respect to the string 14.

Figure 15:
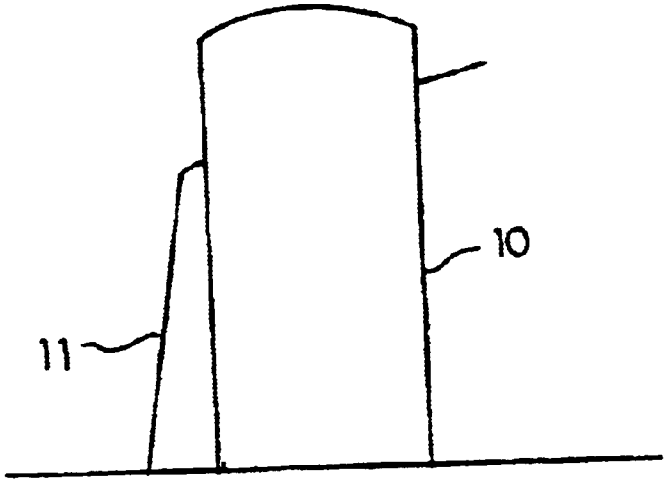

FIG. 15 in a side view illustrates jack 10 having a hole front to back, spring 11 passing through the hole.

Figure 15A:
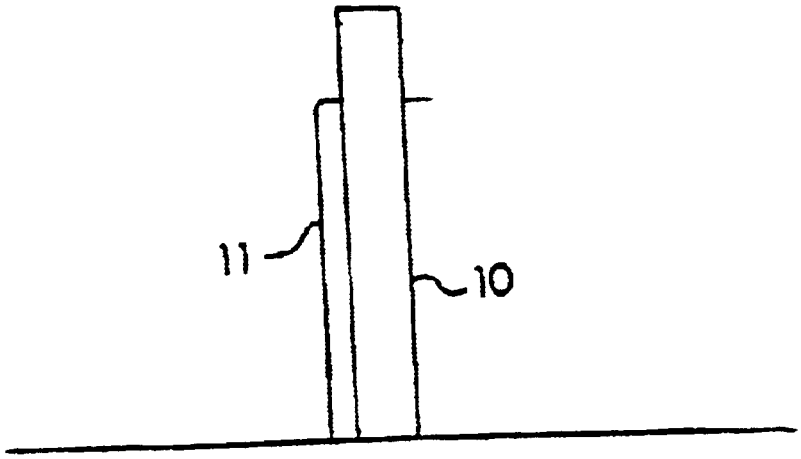

FIG. 15A in a front view illustrates jack 10 having a hole side to side, spring 11 passing through the hole.

Figure 16:
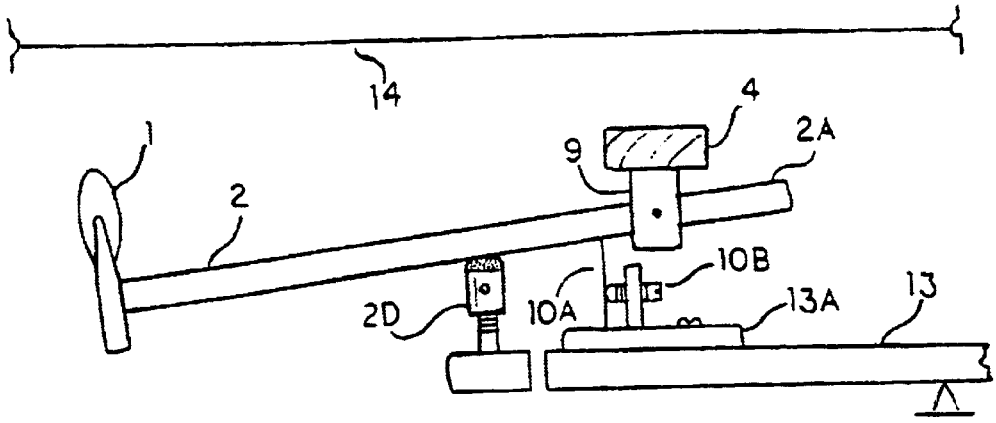

FIG. 16 in a side view illustrates hammer shank 2 in a conventional grand piano layout to be lifted by flexible jack 10A, the hammer shank 2 resting on an adjustable cushioned button 2D.

Figure 17:
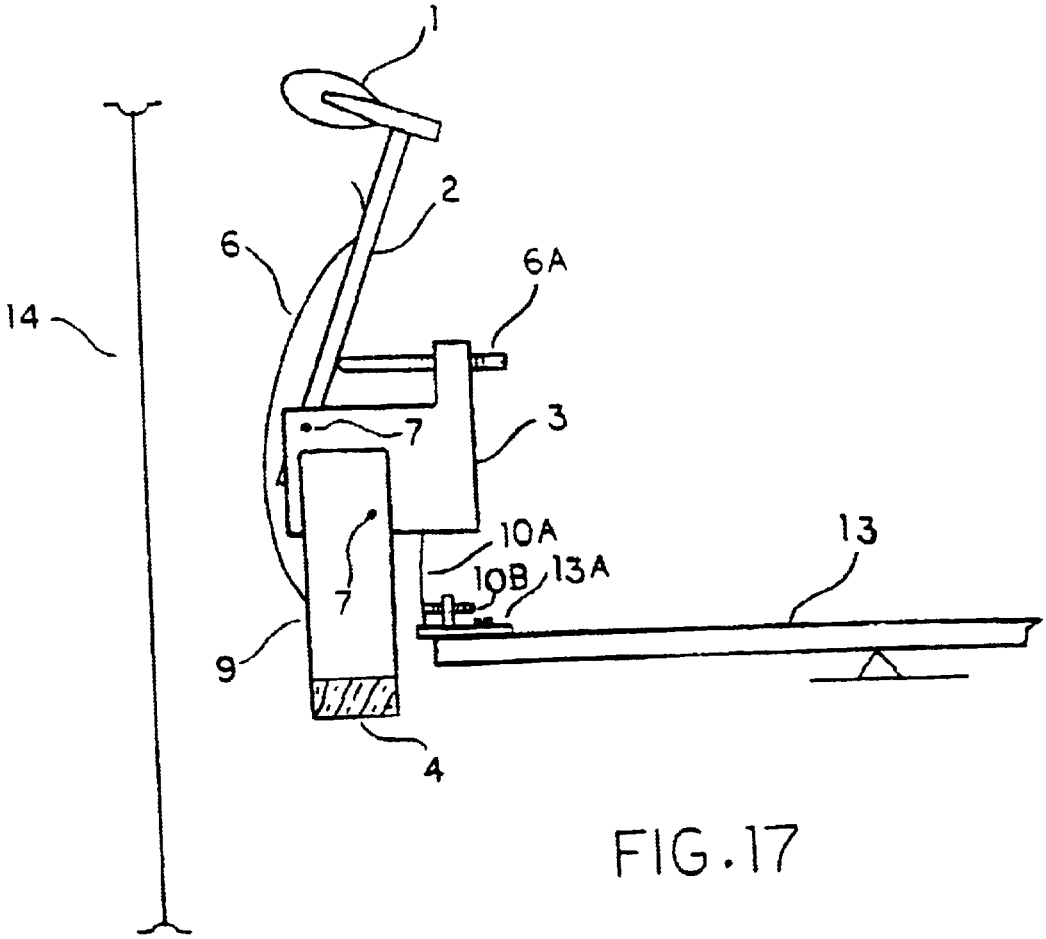

FIG. 17 in a side view illustrates flexible jack 10A adjoining a regulating screw 10B on an adjustable stage 13A, a spring 6 pressing hammer shank 2 against regulating screw 6A.

FIG. 1
39 hammer shank rest
40 hammer
41 hammer shank
42 knuckle
43 drop regulation screw
44 repetition lever
45 spring
46 spoon
47 regulation button
jack
49 rail
50 flange
51 escapement let-off button
52 pad on repetition lever 44
53 rail
54 wippen
55 back chek
56 piano key
74 string FIG. 2
56 piano key
57 hammer
58 hammer shank
59 hammer rail
60 butt
61 catcher shank
62 catch
63 back chek
64 back chek wire
65 bridle tape
66 jack spring
67 bridle wire
68 wippen
69 capstan
70 escapement let-off button
71 jack
72 hammer return spring
73 center rail
74 string.

DESCRIPTION OF THE EMBODIMENTS

The embodiments of the present universal piano action have a yielding jack, operating without let off biasing means; the yielding jack may be flexible or substantially rigid and pivotal supported by a spring means; the yielding jack being positioned on a rear portion of a piano key; a lifting surface of the yielding jack lifting a pivotal member carrying a piano hammer; the pivotal member having a straight undersurface may be a hammer shank as in a grand piano without the knuckle, as illustrated in FIGS. 5,6,10,11,14. or a butt as in a upright piano, as illustrated in FIGS. 4,4A,5,12,15. or a rectangular member having a first end A, and a second end B, as illustrated in FIGS. 1,2,3, the lifting surface of the yielding jack being in contact with the straight undersurface of the pivotal member during the piano hammer striking an rebounding from a tensioned string; the pivotal member carrying the piano hammer being lifted by the lifting surface of the yielding jack in a sliding manner; the straight undersurface of the pivotal member urging the lifting surface of the yielding jack in the sliding manner, in a direction away of a pivot of the pivotal member; the piano hammer striking the tensioned string and rebounding to a variable point away of a normal at rest position of the piano hammer; this variable point away of the normal at rest position of the piano hammer being effected by the straight undersurface of the pivotal member rebounding in contact with the lifting surface of the yielding jack; the lifting surface of the yielding jack locking on to a variable point on the straight undersurface of the pivotal member; whereby positioning the rebounded piano hammer at the variable point away of the normal at rest position of the piano hammer; the position of the rebounded piano hammer varying with amounts of force applied to the piano key; strength of the spring means supporting the jack; strength of the flexible jack, and to weight of the piano hammer; the rebounded piano hammer remaining at this variable point away of the normal at rest position of the piano hammer, until releasing the piano key; whereby unlocking the lifting surface of the yielding jack from the variable point on the straight undersurface of the pivotal member permitting the rebounded piano hammer to return to the normal at rest position of the piano hammers; the piano hammer resting on a flexible back check on an adjustable stage, adjustable along the rear portion of the piano key.

Side views diagrammatically illustrate identical parts for upright and grand pianos for striking vertical strings and horizontal strings from below and above the horizontal strings.

FIG. 3 illustrates a support member 9 fixed to a rail 4 a pivotal member 3 being connected pivotally to the support member 9 a pivotal jack 10 supported by a spring 11 being positioned on an adjustable stage 13A the adjustable stage 13A being adjustable along piano key 13 the pivotal member 3 resting on the pivotal jack 10 a hammer shank 2 carrying a piano hammer 1 being fixed to the pivotal member 3 to strike a vertical string 14 a return spring 6 abutting an extension 6A on the pivotal member 3 to return the piano hammer 1 on rebound to an at-rest position.

FIG. 4 illustrates hammer shank 2 carrying the piano hammer 1 being fixed in position on the pivotal member 3 to strike a horizontal string 14 from above the horizontal string 14 a screw 12 to regulate tension of the return spring 6. Reference numeral 8 denotes dampers reference numeral 7 denotes pivots.

FIG. 5 illustrates the support member 9 carrying the pivotal member 3 being reversed along with the pivotal jack 10 the hammer shank 2 carrying the piano hammer 1 being fixed in position to the reversed side of the pivotal member 3 to strike the horizontal string 14 from below the horizontal string 14 as in a conventional grand piano reference numeral 7 denotes pivots. Reference numeral 8 denotes dampers.

FIG. 6 in a side view diagrammatically illustrates a piano hammer 1 positioned on pivotal member 3 in different attitudes for striking a vertical string 14 and for striking horizontal strings from above and below the horizontal strings 14, an adjustable stage 13A is for adjusting the pivotal jack 10 along/under the pivotal member 3, spring 11 is supporting pivotal jack 10, spring 6 is a hammer return spring, #7 is a pivot, #9 is a support member, #4 is a rail.

FIG. 6A in a side view diagrammatically illustrates the pivotal member 3 carrying the piano hammer 1 being reversed from FIG. 4 for the piano hammer 1 to strike the horizontal string 14 from below in a conventional grand piano layout.

FIG. 7 in a side view diagrammatically illustrates a pivotal hammer shank 2 carrying a piano hammer 1, the pivotal hammer shank 2 being pivotally connected to a pivotal member 3; the pivotal member 3 being pivotally connected to a support member 9; a rigid pivotal jack 10 supported by a spring 11 being pivotally connected to a piano key 13; a screw 16A positioned on the pivotal member 3 abutting a proximal end of the pivotal hammer shank 2 to regulate proximity of the piano hammer 1 in respect to a tensioned horizontal string 14. Reference numeral 7 denotes a pivot; reference numeral 16B denotes a plate holding regulating screw 16A.

FIG. 8 in a side view diagrammatically illustrates a pivotal hammer shank 2 carrying a piano hammer 1 connected pivotally to a support member 9 in a conventional grand piano attitude, pivotal jack 10 is supported by a spring 11, the spring 11 is positioned on an adjustable stage 13B, a spring 11B catches the piano hammer 1 upon releasing piano key 13 to an at rest position, the spring 11B is positioned on an adjustable stage 13C, 11A is a jack regulating screw.

FIGS. 9, 10 and 11 diagrammatically illustrate sequential movement of the piano action. FIG. 7 illustrates pivotal jack 10 supported by a spring 11 under pivotal member 3 in a normal at rest position, a return spring 6 pressing on hammer shank 2, pivotal jack 10 is positioned on a rear portion of piano key 13.

FIG. 10 illustrates pivotal jack 10 lifting pivotal member 3 in a sliding manner and pivotal member 3 urging pivotal jack 10 in a sliding manner in a direction away of pivot 7.

FIG. 11 illustrates piano hammer 1 striking tensioned piano string 14 and pivotal jack 10 being urged by supporting spring 11 to a normal at rest position as illustrated in FIG. 7.

FIG. 10 also illustrates piano hammer 1 rebounded from tensioned piano string 14 to a point away of a normal at rest position of the piano hammer 1 and the pivotal member 3 being locked on to the pivotal jack 10. and on releasing the piano key 13 the pivotal member 3 unlocking from the pivotal jack 10 in a sliding manner, the supporting spring 11 urges pivotal jack 10 in a sliding manner back to the normal at rest position as illustrated in FIG. 7 and return spring 6 urges the pivotal member 3 back to the normal at rest position as illustrated in FIG. 7.

FIG. 12 illustrates diagrammatically a support member 9 supporting pivotally a hammer shank 2 carrying a piano hammer 1, a pivotal jack 10 supported by a spring 11 being situated on a rear portion of an associated piano key 13 on on adjustable stage 13A. on depressing the associated piano key 13 the pivotal jack 10 in a sliding manner in a direction away of a pivot 7 lifting the hammer shank 2, the pivotal jack 10 by lifting the hammer shank 2 is urged by the hammer shank 2 in the direction away of the pivot 7Fin opposition of the spring 11 supporting the pivotal jack 10, the pivotal jack 10 lifting the hammer shank 2 and propelling the harmer shank 2 carrying the piano hammer 1 and the piano hammer 1 striking an associated tensioned horizontal piano string 14 and the piano hammer 1 rebounding from the associated tensioned horizontal piano string 14 to a point away of a normal at rest position of the piano hammer 1, This point away of the normal at rest position of the piano hammer 1 being effected by the hammer shank 2 rebounding with the pivotal jack 10 in opposition of the spring 11 supporting the pivotal jack 10, the pivotal jack 10 from the instant of lifting the hammer shank 2 being in contact with the hammer shank 2, the pivotal jack 10 locking on to a point on the hammer shank 2 whereby positioning the rebounded piano hammer 1 at the point away of the normal at rest position of the piano hammer 1 and holding the rebounded piano hammer 1 at the point away of the normal at rest position of the piano hammer 1 until releasing the associated piano key 13 whereby unlocking the pivotal jack 10 from the point on the hammer shank 2 thus permitting the rebounded piano hammer 1 to return to its normal at rest position.

FIG. 13 in a side view diagrammatically illustrates a support member 9 pivotally supporting a hammer shank 2 carrying a piano hammer 1, said hammer shank 2 having an extended proximal end 2A a pivotal jack 10 supported by a spring 11 being positioned on a rear portion of a piano key 13 on an adjustable stage 13A.

On depressing the piano key 13 the pivotal jack 10 in a sliding manner in a direction away of a pivot 7 lifting the extended proximal end 2A, the pivotal jack 10 by lifting the extended proximal end 2A being urged by the extended proximal end 2A in the direction away of the pivot 7 in opposition of the spring 11 supporting pivotal jack 10, pivotal jack 10 lifting extended proximal end 2A and propelling hammer shank 2 carrying piano hammer 1 and piano hammer 1 striking a tensioned horizontal string 14 from above the tensioned horizontal string 14, and piano hammer 1 rebounding from the tensioned horizontal string 14 to a point away of a normal at rest position of piano hammer 1 this rebound point away of the normal at rest position of the piano hammer 1 being effected by the extended proximal end 2A simultaneously rebounding in contact with the pivotal jack 10 in opposition of the spring 11 supporting jack 10 as the pivotal jack 10 from the instant of lifting the extended proximal end 2A remaining in contact with extended proximal end 2A, The pivotal jack 10 locking on to a point on extended proximal end 2A whereby positioning the rebounded piano hammer 1 at the rebound point away of the normal at rest position of the piano hammer 1 and holding the rebounded piano hammer 1 at the rebound point away of the normal at rest position of the piano hammer 1 until releasing the piano key 13 whereby unlocking the jack 10 from the point on the extended proximal end 2A thus permitting the rebounded piano hammer 1 to return to the normal at rest position of the piano hammer 1, a spring 6 pressing on the extended proximal end 2A to return the piano hammer 1 to the normal at rest position.

FIG. 14 in a side view diagrammatically illustrates a pivotal jack 10 on an adjustable stage 13A positioned on a piano key 13, a spring 11 on an adjustable stage 13A supporting the pivotal jack 10, a pivotal member 3 resting on the pivotal jack 10, a hammer shank 2 is pivotally connected to the pivotal member 3, a spring 6 pressing the hammer shank 2 against an adjustable screw 6A positioned on the pivotal member 3, the screw 6A regulating proximity of a piano hammer 1 carried by the hammer shank 2 in respect to a tensioned string 14.

FIG. 15 in a side view diagrammatically illustrates jack 10 having a hole front to back, spring 11 passing through the hole, FIG. 15A in affront view diagrammatically illustrates jack 10 having a hole side to side, spring 11 passing through the hole.

FIG. 16 in a side view diagrammatically illustrates a hammer shank 2 carrying a piano hammer 1 in a conventional grand piano attitude, a piano key 13 carrying an adjustable stage 13A the adjustable stage 13A carrying a flexible jack 10A, the flexible jack 10A having a regulating screw 10B to regulate position of the flexible jack 10A under the hammer shank 2. Reference numeral 9 denotes a support member carrying the hammer shank 2, reference numeral 2A denotes an extended proximal end of the hammer shank 2. 2D is a hammer shank rest regulating button.

FIG. 17 in a side view diagrammatically illustrates flexible jack 10A adjoining regulating screw 10B on an adjustable stage 13A spring 6 pressing hammer shank 2 against a regulating screw 6A.

I claim:

1. A universal piano action for emplacement in upright pianos and grand pianos below and above strings; comprising a hammer shank carrying a piano hammer; a base end of said hammer shank being pivotally connected to a support member; a substantially rigid pivotal jack supported by a spring means being positioned on a rear portion of a piano key; said spring means pressing said pivotal jack against an abutment in a direction towards a pivot of said support member; upon depressing said piano key a lifting surface of said pivotal jack lifting a substantially straight lifting surface of said hammer shank in a sliding manner; said undersurface of said hammer shank urging said lifting surface of said pivotal jack in said sliding manner pushing said pivotal jack in opposition to said spring means supporting said pivotal jack into a substantial incline in a direction away of said pivot of said support member; said incline being effected by gravity of said hammer shank and said piano hammer upon said lifting surface of said pivotal jack; angle of said pivotal jack in said incline varying with amounts of force applied to said piano key; said pivotal jack remaining in said incline until release of said piano key returning said pivotal jack to its normal upstanding attitude; said piano hammer being propelled towards a tensioned horizontal string; and rebounding from said tensioned horizontal string during said lifting surface of said pivotal jack being in contact with said undersurface of said hammer shank; said lifting surface of said pivotal jack locking onto a variable point on said undersurface of said hammer shank; whereby positioning said piano hammer at a variable rebound position; said lifting surface of said pivotal jack unlocking from said variable point on said undersurface of said hammer shank upon releasing said piano key permitting said piano hammer to return to its normal at rest position from said variable rebound position; said variable rebound position of said piano hammer being effected by amounts of force applied to said piano key and to tension strength of said spring means supporting said pivotal jack and to weight of said piano hammer; said universal piano action operating without escapement let off biasing means.

2. A universal piano action according to claim 1 wherein said spring means supporting said pivotal jack against an abutment.

3. A universal piano action according to claim 1 wherein said spring means supporting said pivotal jack against a regulating screw.

4. A universal piano action according to claim 2 wherein said pivotal jack supported by said spring means having a long substantially straight lifting surface, operating without said abutment.

5. A universal piano action according to claim 3 wherein said pivotal jack supported by said spring means having a long substantially straight lifting surface, operating without said regulating screw.

6. A universal piano action according to claim 1 wherein said pivotal jack having a groove; said spring means functioning in said groove.

7. A universal piano action according to claim 1 wherein said pivotal jack having a through hole running from side to side; said spring means functioning therein.

8. A universal piano action according to claim 1 wherein said pivotal jack having a through hole running diagonally front to back; said spring means functioning therein.

9. A universal piano action according to claim 1 wherein said pivotal jack and said spring means supporting said pivotal jack being carried by a stage; said stage being adjustable along said rear portion of said piano key.

10. A universal piano action according to claim 1 wherein said pivotal jack being carried by a stage; said stage being adjustable along said rear portion of said piano key, and said spring means supporting said pivotal jack being carried by a stage next to said stage carrying said pivotal jack; said stage carrying said spring means being adjustable along said rear portion of said piano key.

11. A universal piano action according to claim 1 wherein said pivotal jack being carried by a stage; said stage being adjustable along said rear portion of said piano key, and said spring means supporting said pivotal jack being carried by a stage; said stage being adjustable along said stage carrying said pivotal jack.

12. A universal piano action according to claim 1 wherein said piano hammer resting on a flexible back check positioned on an adjustable stage.

13. A universal piano action according to claim 1 wherein said piano hammer resting on a flexible back check positioned on an adjustable stage, adjustable along said rear portion of said piano key.

14. A universal piano action according to claim 1 wherein said hammer shank carrying said piano hammer being supported by a cushioned adjustable button.

15. A universal piano action according to claim 1 wherein said base end of said hammer shank being extended; said lifting surface of said pivotal jack adjoining an undersurface of said extended base end; said piano hammer pointing downwards from above said tensioned horizontal string; said lifting surface of said pivotal jack lifting said undersurface of said extended base end, propelling said piano hammer downwards, striking said tensioned horizontal string downwardly from above said tensioned horizontal string.

16. A universal piano action according to claim 15 wherein a hammer return spring means acting upon a top surface of said extended base end.

17. A universal piano action for emplacement in upright pianos and grand pianos below and above strings; comprising a hammer shank carrying a piano hammer; a base end of said hammer shank being pivotally connected to a support member; a substantially flexible jack being positioned on a rear portion of a piano key; upon depressing said piano key a lifting surface of said flexible jack lifting a substantially straight undersurface of said hammer shank in a sliding manner; said undersurface of said hammer shank urging said lifting surface of said flexible jack in said sliding manner pushing said flexible jack into a substantial incline in a direction away of a pivot of said support member; said incline being effected by gravity of said hammer shank and said piano hammer upon said lifting surface of said flexible jack; angle of said flexible jack in said incline varying with amounts of force applied to said piano key; said flexible jack remaining in said incline until release of said piano key returning said flexible jack to its normal upstanding attitude; said piano hammer being propelled towards a tensioned horizontal string; said piano hammer striking said tensioned horizontal string and rebounding during said lifting surface of said flexible jack being in contact with said undersurface of said hammer shank; said lifting surface of said flexible jack locking on to a variable point on said undersurface of said hammer shank; whereby positioning said piano hammer at a variable rebound position; said lifting surface of said flexible jack unlocking from said variable point on said undersurface of said hammer shank upon releasing said piano key permitting said piano hammer to return to its normal at rest position from said variable rebound position; said variable rebound position of said piano hammer being effected by amounts of force applied to said piano key and to tension strength of said flexible jack and to weight of said piano hammer; said universal piano action operating without escapement let off biasing means.

18. A universal piano action according to claim 17 wherein said flexible jack being a flat spring means.

19. A universal piano action according to claim 17 wherein said flexible jack being substantially straight.

20. A universal piano action according to claim 17 wherein said flexible jack being curvate.

21. A universal piano action according to claim 17 wherein said flexible jack abutting a regulating screw keeping said adjustable jack in an optimal lifting position.

22. A universal piano action according to claim 17 wherein said flexible jack being carried by a stages; said stage being adjustable along said rear portion of said piano key.

23. A universal piano action according to claim 17 wherein said flexible jack having a predetermined cross sectional shape.

24. A universal piano action according to claim 17 wherein said flexible jack being of a predetermined flexure with respect to its lenght.

25. A universal piano action according to claim 17 wherein said base end of said hammer shank being extended; said lifting surface of said flexible jack adjoining an undersurface of said extended base end; said piano hammer pointing downwards from above said tensioned horizontal string; said lifting surface of said flexible jack lifting said undersurface of said extended base end, propelling said piano hammer downwards, striking said tensioned horizontal string downwardly from above said tensioned horizontal string.

26. A universal piano action according to claim 25 wherein a hammer return spring means acting upon a top surface of said extended base end.

27. A universal piano action operating without escapement let off biasing means; for emplacement in upright pianos and grand pianos below and above strings; comprising a pivotal member having a first end and a second end; said first end carrying a hammer shank carrying a piano hammer; said piano hammer facing a tensioned horizontal string from below; a substantially straight undersurface of said first end resting on a substantially rigid pivotal jack supported by a spring means; said jack being positioned on a rear portion of a piano key; said piano hammer striking said tensioned horizontal string and rebounding during said jack being in continual contact with said substantially straight undersurface of said first end.

28. A universal piano action according to claim 27 wherein said pivotal member further comprising a damper positioned on a top surface of said second end.

29. A universal piano action according to claim 27 wherein said lifting surface of said jack being substantially straight and longer than said substantially straight undersurface of said first end.

30. A universal piano action according to claim 27 wherein said piano hammer carried by said hammer shank, carried by said first end of said pivotal member pointing downwards, facing said tensioned horizontal string from above; a substantially straight undersurface of said second end of said pivotal member resting on said lifting surface of said pivotal jack positioned on said rear portion of said piano key; said piano hammer striking said tensioned horizontal string downwardly.

31. A universal piano action according to claim 30 wherein a hammer return spring means acting upon a top surface of said second end.

32. A universal piano action according to claim 30 wherein a damper dependent from said rear portion of said piano key touching said tensioned horizontal string.

33. A universal piano action according to claim 30 wherein said piano hammer carried by said hammer shank, carried by said first end of said pivotal member facing a tensioned vertical string; said substantially straight undersurface of said second end of said pivotal member resting on said lifting surface of said pivotal jack positioned on said rear portion of said piano key; said piano hammer striking said tensioned vertical string.

34. A universal piano action according to claim 33 wherein a hammer return spring means acting upon a top surface of said second end.

35. A universal piano action according to claim 27 wherein said substantially straight undersurface of said first end resting on a lifting surface of a substantially flexible jack.

36. A universal piano action according to claim 30 wherein said substantially straight undersurface of said second end resting on a lifting surface of a substantially flexible jack.

37. A universal piano action according to claim 33 wherein said substantially straight undersurface of said second end resting on a lifting surface of a substantially flexible jack.

38. A universal piano action according to claim 27 Wherein a base end of said hammer shank being in a recess in said first end being pivotally attached to said first end; a top surface said base end of said hammer shank in said recess by gravity of said piano hammer acting against a regulating screw carried by a top of said first end in said recess; said regulating screw regulating distance between said tensioned horizontal string and said piano hammer.

39. A universal piano action according to claim 38 wherein said base end of said hammer shank being pivotally attached to said first end in said recess; said piano hammer facing a tensioned vertical string; a hammer return spring means urging said hammer shank against said regulating screw horizontally disposed along said top surface of said first end; said regulating screw regulating distance between said piano hammer and said tensioned vertical string.

40. A universal piano action according to claim 39 wherein said hammer shank having a groove; said hammer return spring means urging said groove, urging said hammer shank against said regulating screw carried by said top surface of said first end.

41. A universal piano action comprising a pivotal jack; a pivotal member carrying a piano hammer; a lifting surface of said jack in a sliding manner lifting an undersurface of said pivotal member propelling said piano hammer towards a tensioned string; said jack being pressed by a spring means against an abutment; said lifting surface of said jack being in contact with said undersurface of said pivotal member during said piano hammer striking said tensioned string and rebounding from said tensioned string effectuated by absence of a jack escapement means; weight of said piano hammer and said pivotal member via said undersurface of said pivotal member upon being lifted by said jack pushing said lifting surface of said jack pushing said jack into a substantial incline in a direction away of a pivot of said pivotal member in opposition to said spring means pressing said jack in a direction towards said pivot; said jack remaining in said incline until said piano hammer being returned to an at rest position by releasing a piano key operating said universal piano action.

42. A universal piano action striking vertical strings and horizontal strings from at least one direction, comprising a hammer shank carrying a piano hammer; a base end of said hammer shank being connected pivotally to a support members a substantially rigid pivotal jack being positioned on a rear portion of a piano keys a lifting surface of said pivotal jack lifting a substantially straight undersurface of said hammer shank in a sliding manners said undersurface of said hammer shank urging said lifting surface of said pivotal jack in said sliding manner in a direction away of a pivot of said support members effected by gravity of said hammer shank and said piano hammer upon said lifting surface of said pivotal jack; said piano hammer being propelled towards a tensioned horizontal strings said piano hammer striking said tensioned horizontal string and rebounding from said tensioned horizontal string, during said lifting surface of said pivotal jack being in contact with said undersurface of said hammer shank; said lifting surface of said pivotal jack locking onto a variable point on said undersurface of said hammer shank; whereby positioning said piano hammer at a variable rebound positions said lifting surface of said pivotal jack unlocking from said variable point on said undersurface of said hammer shank, upon releasing said piano keys permitting said piano hammer to return to its normal at rest position from said variable rebound positions said variable rebound position of said piano hammer being effected by amounts of force applied to said piano key and to tension strength of a spring means supporting said pivotal jack, and to weight of said piano hammers said universal piano action operating without escapement let off biasing means and wherein said pivotal jack includes a through hole running from side to side; said spring means functioning therein.

43. The universal piano action according to claim 42 wherein said pivotal jack includes a through hole running diagonally front to back; said spring means functioning therein.

44. The universal piano action according to claim 42 wherein said pivotal jack and said spring means supporting said pivotal jack being carried by a stages said stage being adjustable along said rear portion of said piano key.

45. The universal piano action according to claim 42 wherein said pivotal jack being carried by a stage; said stage being adjustable along said rear portion of said piano key, and said spring means supporting said pivotal jack being carried by a stage next to said stage carrying said pivotal jack; said stage carrying said spring means being adjustable along said rear portion of said piano key.

46. The universal piano action according to claim 42 wherein said pivotal jack being carried by a stage; said stage being adjustable along said rear portion of said piano key, and said spring means supporting said pivotal jack being carried by a stage; said stage being adjustable along said stage carrying said pivotal jack.

47. The universal piano action according to claim 42 wherein said piano hammer rests on a flexible back check positioned on an adjustable stage.

48. The universal piano action according to claim 42 wherein said piano hammer resting on a flexible back check positioned on an adjustable stage, adjustable along said rear portion of said piano key.

49. The universal piano action according to claim 42 wherein said hammer shank carrying said piano hammer being supported by a cushioned adjustable button.

50. The universal piano action according to claim 42 wherein said base end of said hammer shank being extended; said lifting surface of said pivotal jack adjoining an undersurface of said extended base end; said piano hammer pointing downwards from above said tensioned horizontal string; said lifting surface of said pivotal jack lifting said undersurface of said extended base end propelling said piano hammer downwards, striking said tensioned horizontal string downwardly from above said tensioned horizontal string.

51. A universal piano action for emplacement in upright pianos and in grand pianos below and above strings, comprising a hammer shank carrying a piano hammer; a base end of said hammer shank being connected pivotally to a support members a substantially flexible jack being positioned on a rear portion of a piano key; a lifting surface of said flexible jack lifting a substantially straight undersurface of said hammer shank in a sliding manners said undersurface of said hammer shank urging said lifting surface of said flexible jack in said sliding manner, in a direction away of a pivot of said support member, effected by gravity of said hammer shank and said piano hammer upon said lifting surface of said flexible jack; said piano hammer being propelled towards a tensioned horizontal strings said piano hammer striking said tensioned horizontal string and rebounding during said lifting surface of said flexible jack being in contact with said undersurface of said hammer shanks said lifting surface of said flexible jack locking onto a variable point on said undersurface of said hammer shanks whereby positioning said piano hammer at a variable rebound positions said lifting surface of said flexible jack unlocking from said variable point on said undersurface of said hammer shank, upon releasing said piano key, permitting said piano hammer to return to its normal at rest position from said variable rebound position; said variable rebound position of said piano hammer being effected by amounts of force applied to said piano key and to tension strength of said flexible jack and to weight of said piano hammer; said universal piano action operating without escapement let off biasing means; and wherein said flexible jack being carried by a stage; said stage being adjustable along said rear portion of said piano key.

52. A universal piano action according to claim 51 wherein said base end of said hammer shank being extended; said lifting surface of said flexible jack adjoining an undersurface of said extended base ends said piano hammer pointing downwards from above said tensioned horizontal string; said lifting surface of said flexible jack lifting said undersurface of said extended base end, propelling said piano hammer downwards, striking said tensioned horizontal string downwardly from above said tensioned horizontal string.

53. The universal piano action according to claim 52 wherein a hammer return spring means is acting upon a top surface of said extended base and.

54. The universal piano action striking plurality of vertical and horizontal strings from two directions; comprising a pivotal member having a first end and a second ends said first end carrying a hammer shank carrying a piano hammer; said piano hammer facing a tensioned horizontal string from below; a substantially straight undersurface of said first end resting on a substantially rigid pivotal jack supported by a spring means; said jack being positioned on a rear portion of a piano key; said piano hammer striking said tensioned horizontal string and rebounding—during said lifting surface of said jack being in contact with said substantially straight undersurface of said first end; and wherein said piano hammer carried by said hammer shank, carried by said first end of said pivotal member pointing downwardly, facing said tensioned horizontal string upwardly; a substantially straight undersurface of said second end of said pivotal member resting on said lifting surface of said pivotal jack positioned on said rear portion of said piano key; said piano hammer striking said tensioned horizontal string downwardly.

55. The universal piano action according to claim 54 wherein a hammer return spring means acts upon a top surface of said second end.

56. The universal piano action according to claim 54 wherein a damper dependent from said rear portion of said piano key touching said tensioned horizontal string.

57. The universal piano action according to claim 54 wherein said piano hammer carried by said hammer shank, carried by said first end of said pivotal member facing a tensioned vertical string; said substantially straight undersurface of said second end of said pivotal member resting on said lifting surface of said pivotal jack positioned on said rear portion of said piano keys said piano hammer striking said tensioned vertical string.

58. The universal piano action according to claim 57 wherein a hammer return spring means acting upon a top surface of said second end.

59. A universal piano action according to claim 54 wherein substantially straight undersurface of said first end resting on a lifting surface of a substantially flexible jack.

60. The universal piano action according to claim 54 wherein said substantially straight undersurface of said second end resting on a lifting surface of a substantially flexible jack.

61. A universal piano action according to claim 57 wherein said substantially straight undersurface of said second end resting on a lifting surface of a substantially flexible jack.

62. A piano action for emplacement in upright and grand pianos below and above strings; comprising a substantially flexible jack carried by a rear portion of a piano keys a pivotal member carrying a piano hammer; upon depressing said piano key weight of said piano hammer and said pivotal member in a sliding manner pushing a top of said flexible jack positioning said flexible jack into a substantial incline in a direction away of a pivot of said pivotal member; said flexible jack remaining in said incline until release of said piano key; said top of said flexible jack supporting said pivotal member during said piano hammer being propelled towards a tensioned strings said top of said flexible jack supporting said pivotal member during said piano hammer striking said tensioned strings said top of said flexible jack supporting said pivotal member during said piano hammer rebounding from said tensioned strings said top of said flexible jack supporting said pivotal member during release of said piano key.

63. A piano action for emplacement in upright pianos and grand pianos below and above strings; comprising a pivotal jack acted upon by a spring means against an abutment in a direction towards a pivot of a pivotal member carrying a piano hammer; said pivotal jack being carried by a rear portion of a piano keys upon depressing said piano key weight of said piano hammer and said pivotal member in a sliding manner pushing a top of said pivotal jack positioning said pivotal jack into a substantial incline in a direction away of said pivot of said pivotal members said pivotal jack remaining in said incline until release of said piano key; said top of said pivotal jack supporting said pivotal member during said piano hammer being propelled towards a tensioned string; said top of said pivotal jack supporting said pivotal member during said piano hammer striking said tensioned string; said top of said pivotal jack supporting said pivotal member during said piano hammer rebounding from said tensioned string; said top of said pivotal jack supporting said pivotal member during release of said piano key.

64. A piano action for emplacement in an upright piano according to claim 63 wherein said pivotal jack being carried by a stage of predetermined height on said rear portion of said piano key.

* * * * *